US008322710B2

(12) United States Patent
Andoh et al.

(10) Patent No.: US 8,322,710 B2
(45) Date of Patent: Dec. 4, 2012

(54) AUTOMATIC DOCUMENT FEEDER WITH SHEET DETECTOR

(75) Inventors: Takayuki Andoh, Kanagawa (JP); Kohji Hatayama, Kanagawa (JP); Yohei Osanai, Kanagawa (JP); Satoshi Narai, Kanagawa (JP); Taku Kudoh, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/064,890

(22) Filed: Apr. 25, 2011

(65) Prior Publication Data

US 2011/0285078 A1 Nov. 24, 2011

(30) Foreign Application Priority Data

May 20, 2010 (JP) ..... 2010-116383

(51) Int. Cl.
*G03G 15/00* (2006.01)

(52) U.S. Cl. ..... 271/145; 399/371

(58) Field of Classification Search ..... 271/9.09, 271/121, 145, 152–155, 162; 399/124, 125, 399/367, 371; 358/498
See application file for complete search history.

(56) References Cited

U.S. PATENT DOCUMENTS

| | | | | |
|---|---|---|---|---|
| 7,212,321 | B2 * | 5/2007 | Sugiyama et al. | 358/498 |
| 2002/0096819 | A1 * | 7/2002 | Fukasawa et al. | 271/121 |
| 2005/0058477 | A1 * | 3/2005 | Aoki et al. | 399/367 |
| 2008/0197560 | A1 * | 8/2008 | Lee et al. | 271/121 |
| 2010/0225977 | A1 | 9/2010 | Osanai et al. | |

FOREIGN PATENT DOCUMENTS

| | | | |
|---|---|---|---|
| JP | 2003095480 | A | 4/2003 |
| JP | 2003095480 | A * | 4/2003 |
| JP | 3824909 | A | 7/2006 |
| JP | 2007331940 | A | 12/2007 |

* cited by examiner

*Primary Examiner* — Jeremy R Severson
(74) *Attorney, Agent, or Firm* — Harness, Dickey & Pierce, P.L.C.

(57) ABSTRACT

An automatic sheet feeder includes a sheet setting unit to set a sheet to be fed by a sheet feeding member, an openably closable cover rotatably disposed over an upper portion of the sheet setting unit, a sheet detector rotatably supported on the cover to detect whether or not a sheet is set on the sheet setting unit and including a detection member, a rotary shaft about which the detection member rotates, and a sensor to detect the setting of the sheet according to a movement of the detection member, and a rotating member to cause the detection member to rotate in a direction such that an angle between a line extending in a longitudinal direction of the detection member and a surface of the sheet set on the sheet setting unit decreases as the cover rotates from an open position to a closed position.

5 Claims, 6 Drawing Sheets

AUTOMATIC DOCUMENT FEEDER WITH SHEET DETECTOR

CROSS-REFERENCE TO RELATED APPLICATIONS

The present invention claims priority pursuant to 35 U.S.C. §119 from Japanese Patent Application No. 2010-116383, filed on May 20, 2010 in the Japan Patent Office, which is hereby incorporated by reference herein in its entirety.

BACKGROUND OF THE INVENTION

1. Field of the Invention

Embodiments of the present invention relate to an automatic sheet feeder to automatically feed and convey a sheet for an image reader to read image data formed on the sheet so as to later perform image forming in an image forming apparatus.

2. Description of the Related Art

Related-art automatic sheet feeders, in which a sheet that is set on a sheet setting unit with a movable cover attached thereto is detected by a sheet detecting unit before being fed and conveyed by a sheet feeding unit, are generally known in the market and are detachably attachable to an image forming apparatus such as a copier and a facsimile machine or an image reading device such as a scanner.

An automatic document feeder (ADF) generally serves as an automatic sheet feeder. Many automatic sheet feeders generally include a feeler to detect whether or not a sheet is set on the sheet setting unit provided therein. When the sheet is set on the automatic sheet feeder, the feeler rotates to switch a state of a photosensor between ON and OFF. The sheet detecting unit may include a feeler that serves as an actuating member and a sensor that detects whether any sheet is set on the automatic sheet feeder according to movement of the feeler. The feeler is movably attached to an upper cover that covers a housing of the automatic sheet feeder from above.

In the automatic sheet feeder having the above-described configuration, when a paper jam occurs and the sheet stops at a sheet feeding portion, a user opens the cover to remove the jammed paper or sets the document in the sheet feeding unit again before closing the cover.

At this time, in a related-art automatic sheet feeder, when the cover is opened for paper jam handling or maintenance and is then closed with a sheet or sheets remaining on a sheet setting unit, the feeler abuts against the sheet(s) on the sheet setting unit, which can damage the sheet(s) and/or to the feeler itself. In a case where the feeler is configured to have enough of a clearance to enable it to smoothly retreat from the surface of an uppermost sheet of the sheets, such damage can be avoided even if the feeler abuts against the sheets. However, a downward slope of a guide face of the sheet feeding unit before an entrance of a sheet separation portion for the purpose of automatically separating the sheets reliably hinders the feeler from moving away from the sheets when it contacts the sheets.

Further, a support for the feeler requires a specific positional arrangement for proper detection of the existence of the sheets on the sheet setting unit. In addition, due to space limitations, the position of the support for the feeler cannot be shifted enough for the feeler to recede from the sheets easily. Therefore, it is difficult to prevent damage to the sheets and/or the feeler itself caused by the feeler inexpensively, that is, without providing extra parts or components.

To address the above-described drawback, Japanese Patent Application Publication No. 2003-095480 (JP-2003-095480-A) discloses a configuration in which a feeler is linked with an upper cover to move with opening and closing of the upper cover so as to prevent the feeler from damaging the sheets and the feeler itself.

However, Japanese Patent Application Publication No. 2003-095480 (JP-2003-095480-A) uses a linking mechanism to link the movement of the upper cover with the feeler, and therefore a large number of parts and components are required. Accordingly, the goal of providing a low-cost mechanism of the automatic sheet feeder to prevent damage to sheets and a feeler cannot be achieved.

SUMMARY OF THE INVENTION

The present invention describes a novel automatic sheet feeder. In one example, an automatic sheet feeder includes a sheet setting unit including a housing, to set a sheet to be fed by a sheet feeding member, an openably closable cover rotatably disposed over an upper portion of the sheet setting unit, a sheet detector rotatably supported on the cover to detect whether or not a sheet is set on the sheet setting unit, the sheet detector including a detection member, a rotary shaft about which the detection member rotates and to which the detection member is fixedly attached, and a sensor to detect the sheet set on the sheet setting unit according to a movement of the detection member, and a rotating member to cause the detection member of the sheet detector to rotate in a direction such that an angle between a line that extends in a longitudinal direction of the detection member and a surface of the sheet set on the sheet setting unit decreases as the cover rotates from an open position to a closed position.

The rotating member may include a lever that is fixedly attached to the rotary shaft and contacts the housing of the sheet setting unit, when the cover closes, to rotate in a direction such that an angle between the detection member and the surface of the sheet decreases.

The above-described automatic sheet feeder may further include a support for the cover and a support for the detection member, and a contact portion of the housing where the housing of the sheet setting unit contacts the lever. The contact portion may be located outside an arc centered on the support for the cover and may be drawn through the support for the detection member.

The contact portion of the housing may be a sloped surface for the lever to move therealong from a contact portion toward a support for the cover as the cover closes.

The lever may pass under the contact portion and withdraw therefrom when the detection member reaches a position lower than a lowest position of the sheet placed on the sheet setting unit prior to the detection member reaching a home position thereof.

The sheet detector may detect that the sheet is set on the sheet setting unit according to a movement of the detection member from a home position thereof to a sheet detection position, and the detection member nay be supported at the home position thereof and the rotating member rotating the detection member to the sheet detection position against the supporting action for the detection member.

BRIEF DESCRIPTION OF THE DRAWINGS

A more complete appreciation of the invention and many of the advantages thereof are obtained as the same becomes better understood by reference to the following detailed description when considered in connection with the accompanying drawings, wherein.

DETAILED DESCRIPTION OF PREFERRED EMBODIMENTS

Figure 1:
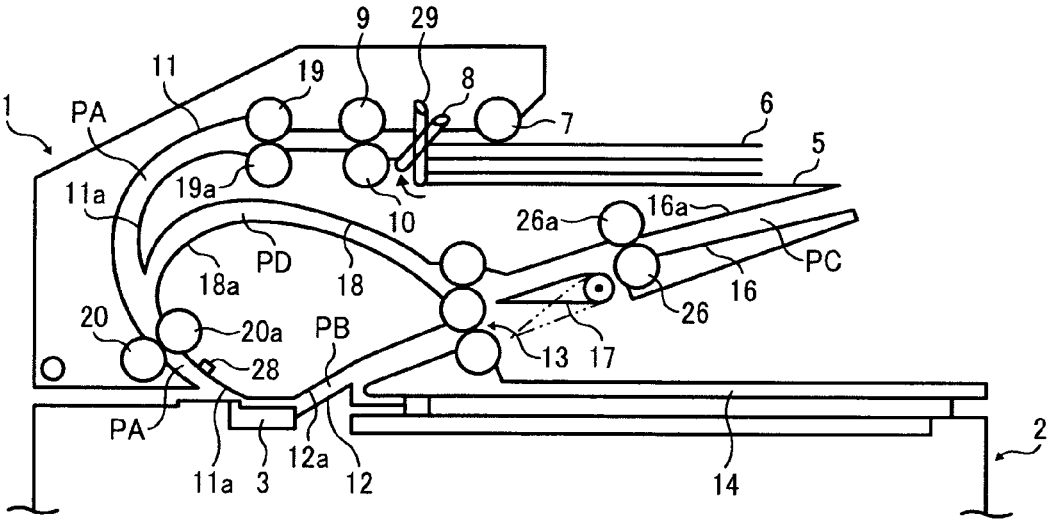
FIG. 1 is a configuration of an automatic document feeder according to an embodiment of the present invention.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would hen be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to the present invention. Elements having the same functions and shapes are denoted by the same reference numerals throughout the specification and redundant descriptions are omitted. Elements that do not require descriptions may be omitted from the drawings as a matter of convenience. Reference numerals of elements extracted from the patent publications are in parentheses so as to be distinguished from those of exemplary embodiments of the present invention.

The present invention includes a technique applicable to any image forming apparatus, and is implemented in the most effective manner in an electrophotographic image forming apparatus.

In describing preferred embodiments illustrated in the drawings, specific terminology is employed for the sake of clarity. However, the disclosure of the present invention is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present invention are described.

FIG. 1 is a cross-sectional view of an automatic document feeder 1 (hereinafter, the ADF 1) according to an exemplary embodiment of the present invention. The ADF 1 serves as an automatic sheet feeder that can feed documents having image data such as text and image formed thereon, blank papers, and other sheet-like recording media.

As illustrated in FIG. 1, the ADF 1 is disposed detachably attachable to an image reading device 2 such as a scanner, for example. The image reading device 2 has a slit glass 3 that corresponds to a reading position provided on an upper surface thereof. An uppermost document of a document stack 6 is fed from the ADF 1 and travels over the slit glass 3 so that an image formed on the uppermost document can be read.

Further, a scan mode is selectable between a one-side scan mode and a duplex scan mode by selecting either scan mode via an operation unit. Thus, the ADF 1 can perform appropriate operations according to the selected scan mode.

In the ADF 1 according to this embodiment of the present invention, a user sets the document 6 on a document setting tray 5 with a surface to be scanned facing up.

Generally, a pickup roller 7 stands by with a given gap across the document setting tray 5. When a document setting sensor, in this case a document detection feeler unit 8, detects that the document stack 6 is set on the document setting tray 5 and a request to start reading is inputted via the operation unit, the pickup roller 7 moves down from a standby position to a contact position where the pickup roller 7 contacts an upper surface of the document stack 6.

The document setting tray 5 includes a document shutter 29. When the pickup roller 7 remains in the standby position without contacting the upper surface of the document stack 6, the document shutter 29 is regulated and prohibited from moving or rotating. When the pickup roller 7 moves down to the contact position for starting to feed the documents of the document stack 6, the document shutter 29 is released to move or rotate in a direction indicated by arrow in FIG. 1. With this configuration, the user can set the document stack 6 by abutting the document stack 6 against one side of the document shutter 29.

The document shutter 29 is disposed separate from the document detection feeler unit 8 that serves as a sheet detector in a width direction of a document of the document stack 6 so that the document shutter 29 and the document detection feeler unit 8 may not interfere with each other.

The uppermost document fed and conveyed by the pickup roller 7 is separated one by one from the other documents of the document stack 6 by a separation mechanism that includes a feed roller 9 and a reverse roller 10. The separation mechanism is not limited thereto but can include the feed roller 9 and a separation pad instead of the reverse roller 10.

As illustrated in FIG. 1, the ADF 1 also includes pathways PA, PB, PC, and PD.

The pathway PA is defined by guides 11 and 11*a* to convey the uppermost document separated from the document stack 6 by the feed roller 9 to the slit glass 3.

The pathway PB is defined by guides 12 and 12*a* to convey the uppermost document passed over the slit glass 3 to a sheet exit 13.

The pathway PC, which is also referred to as the switchback pathway PC, is formed below the document setting tray 5 and defined by guides 16 and 16*a* and by the guide 16*a* and a separation claw 17. The switchback pathway PC switches back the uppermost document (or simply the document) discharged through the sheet exit 13 and conveys the document to the pathway PA again, reversing the direction of conveyance of the document by conveying the trailing edge thereof first.

A discharged sheet stacking tray 14 receives and stacks the document discharged from the sheet exit 13.

The separation claw 17 is disposed above the discharged sheet stacking tray 14. When the separation claw 17 moves from an upward position as illustrated with a solid line to a downward position as illustrated with a dotted line, the document discharged through the sheet exit 13 is guided to the switchback pathway PC. When the document is successfully conveyed to the switchback pathway PC, the separation claw 17 moves back to the upward position, and therefore the document that is switched back via the switchback pathway PC can be guided to the pathway PD, reversing the direction of conveyance of the document such that the trailing edge of the document enters the pathway PD first.

The pathway PD is defined by guides 18 and 18*a* and merged to the pathway PA to convey the document 6 switched back in the switchback pathway PC to the reading position again. A pair of reverse rollers 26 and 26*a* has a stand-alone unit to switch a forward rotation and a reverse rotation to guide the document to the switchback pathway PC, reverse the direction of conveyance of the document, and convey the document to the pathway PD.

The ADF 1 further includes a pair of pre-reading rollers 20 and 20*a* and a sensor 28. The sensor 28 is disposed between a position where the pair of pre-reading rollers 20 and 20*a* are disposed and the reading position where the slit glass 3 is disposed, so as to synchronize the movement of the leading edge of the document conveyed by the pair of pre-reading rollers 20 and 20*a* with a time to start reading the image data formed on the document.

The ADF 1 further includes a document detection feeler unit 8 that remains at the home position thereof under its weight and serves as a sheet detecting unit including a feeler 8*a*, a rotary shaft 8*b* (see FIG. 5), a detection tab 8*c* (see FIG. 5), a tongue portion 8*d* (see FIG. 5), and a through-beam sensor 8*e*. Details of components and functions of the document detection feeler unit 8 will be described later.

Next, a description is given of operations in a one-side scan mode.

When the document stack 6 is set on the document setting tray 5, the feeler 8*a* that is included in the document detection feeler unit 8 to serve as a detection member, rotates about the rotary shaft 8*b* in a clockwise direction in FIG. 1 to change the switch between ON and OFF of the through-beam sensor 8*e*.

If the one-side scan mode is selected or the document stack 6 is loaded on the document setting tray 5 without selecting a duplex scan mode, the one-side scan is performed for a subsequent printing operation. If the START key provided on the operation unit is pressed in a condition that the one-side scan mode is set, the document detection feeler unit 8 detects whether or not any document is set on the document setting tray 5 according to the ON/OFF signal of the through-beam sensor 8*e*.

Once the document detection feeler unit 8 detects that the document stack 6 is set on the document setting tray 5, a motor rotates in a forward direction, the pickup roller 7 moves in a downward direction to press the document stack 6 and to rotate itself in a clockwise direction to feed the uppermost document of the document stack 6 forward. The uppermost document fed by the pickup roller 7 is conveyed to the separation mechanism, where the uppermost document is separated and fed one by one by the feed roller 9 and the reverse roller 10.

As previously described, the separation mechanism includes a combination of the feed roller 9 and the reverse roller 10 or a combination of the feed roller 9 and the separation pad.

When the leading edge of the uppermost document, or simply the document, fed by the separation mechanism is detected by the sensor 28 disposed between the pair of pre-reading rollers 20 and 20*a* and the slit glass 3, the reading start time of the document is synchronized with the movement of the leading edge of the document to start reading the document.

When the sensor 28 detects the trailing edge of the fed document, a reading end time of the document is synchronized with the movement of the trailing edge of the document to stop reading the document.

When the one-side scan mode is set, the separation claw 17 is constantly located at the upward position. Consequently, the scanned document is discharged from the sheet exit 13 to the discharged sheet stacking tray 14 to be stacked thereon with its face down.

Even though the motor is constantly running, the linear velocity of a pair of conveyance rollers 19 and 19*a* may be set faster than the linear velocity of the feed roller 9 so as to obtain space between adjacent documents that are conveyed sequentially. When all the documents of the document stack 6 have been read, the motor starts to run in a reverse direction to move the pickup roller 7 upward to the standby position.

Then, a description is given of operations when the duplex scan mode is selected.

If the START key provided on the operation unit is pressed while the duplex scan mode is selected, the document detection feeler unit 8 detects, according to the ON/OFF signal of the through-beam sensor 8*e*, whether or not the document stack 6 is set on the document setting tray 5. When the document detection feeler unit 8 detects that the document stack 6 is set on the document setting tray 5, the motor rotates in the forward direction, the pickup roller 7 moves in the downward direction to press the upper surface of the document stack 6 and to rotate itself in the clockwise direction to feed the uppermost document in a forward direction. The uppermost document fed by the pickup roller 7 is conveyed to the separation mechanism and fed one by one by the feed roller 9 and the reverse roller 10 (or the separation pad).

Then, when the sensor 28 detects the leading edge of the uppermost document fed by the separation mechanism, the reading start time of the uppermost document is synchronized with the movement of the leading edge of the uppermost document to start reading the image data formed on the uppermost document.

Further, when the sensor 28 detects the trailing edge of the uppermost document, the separation claw 17 shifts to the downward position and the pair of reverse rollers 26 and 26*a* rotates in the forward direction, which is the clockwise direction in FIG. 1.

Further, when the sensor 28 detects the leading edge of the uppermost document, the feed roller 9 and the pickup roller 7 are disconnected by a clutch and remain in a standby state without feeding any additional documents.

When the sensor 28 detects the trailing edge of the uppermost document, the reading end time of the uppermost document is synchronized with the movement of the trailing edge of the uppermost document to stop reading the uppermost document.

At the completion of the above-described operation, the uppermost document is conveyed from the sheet exit 13 into the switch back pathway PC. When a time T has elapsed after the uppermost document passed under the sensor 28, that is, when a time has elapsed after the trailing edge of the uppermost document passed through, the sheet exit 13, the separation claw 17 shifts to the upward position and the pair of reverse rollers 26 and 26*a* rotates in a reverse direction (a counterclockwise direction in FIG. 1) so as to guide the uppermost document to the pathway PD.

The uppermost document entered into the pathway PD is then conveyed to the pathway PA. When the sensor 28 detects the leading edge of the uppermost document, image data formed on the other face of the uppermost document is read. Further, when the sensor 28 detects the leading edge of the uppermost document, the separation claw 17 moves to the downward position again and the pair of reverse rollers 26 and 26*a* starts rotating in the forward direction again. At this time, the pre-reading rollers 20 and 20*a* and the pair of reverse rollers 26 and 26*a* rotate different directions from each other. However, since a torque limiter is mounted on the shaft of the reverse roller 26, the direction of rotation of the pair of reverse rollers 26 and 26*a* can follow that of the pair of pre-reading rollers 20 and 20*a*.

After the completion of reading the other face of the uppermost document, the uppermost document is switched back to the pathway PA. At this time, image data of both faces of the uppermost document are not read. Further, even if the sensor 28 detects the leading edge of the uppermost document, the separation claw 17 moves to the upward position to discharge the uppermost document this time to the discharged sheet stacking tray 14 with the front face of the uppermost document facing down.

When the sensor 28 detects the trailing edge of the uppermost document for the third time, if the document detection feeler unit 8 detects the uppermost document then, the feeding operation of a subsequent document starts.

Then, the above-described operations are repeated until the document detection feeler unit 8 no longer detects the last document of the document stack 6 set on the document setting tray 5. Then, the duplex scan mode for scanning both faces of the document stack 6 set on the document setting tray 5 completes.

Figure 2:
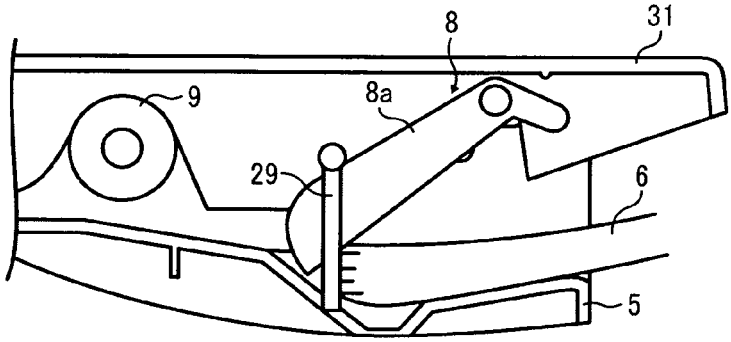
FIG. 2 is a diagram illustrating a state of the automatic document feeder when documents are set on a document setting tray.

FIG. 2 is a cross-sectional view illustrating a state in which the document stack 6 is set on the document setting tray 5.

As illustrated in FIG. 2, the document stack 6 is set by abutting against one side of the document shutter 29. When the START button provided on the operation unit is pressed for reading sheets of the document stack 6, the pickup roller 7 moves in a downward direction and the regulation of the document shutter 29 is released to feed the uppermost document of the document stack 6.

However, when any document fed from the document stack 6 is curled or bent, a paper jam can occur in a pathway, which is any of the pathways PA, PB, PC, and PD.

Figure 3:
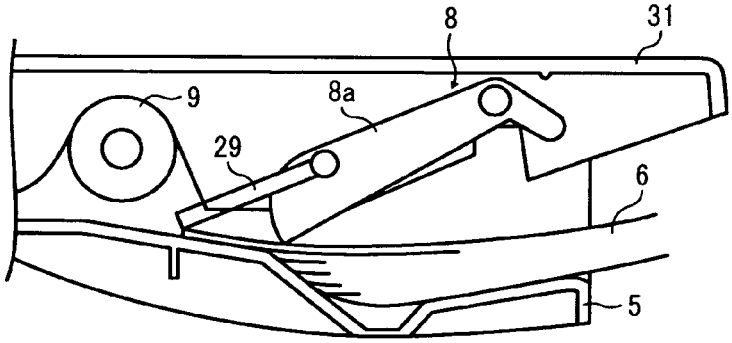
FIG. 3 is a diagram illustrating a state of the automatic document feeder when an uppermost document is fed.

FIG. 3 is a cross-sectional view illustrating a state of a document when a paper jam has occurred while feeding the previous document. However, the position of the subsequent document depends on where the previous document has been jammed.

When handling the paper jam, a user opens a cover 31 to remove the jammed paper(s) and closes the cover 31. In some cases, however, the user may close the cover 31 without removing a subsequent document.

Figure 4:
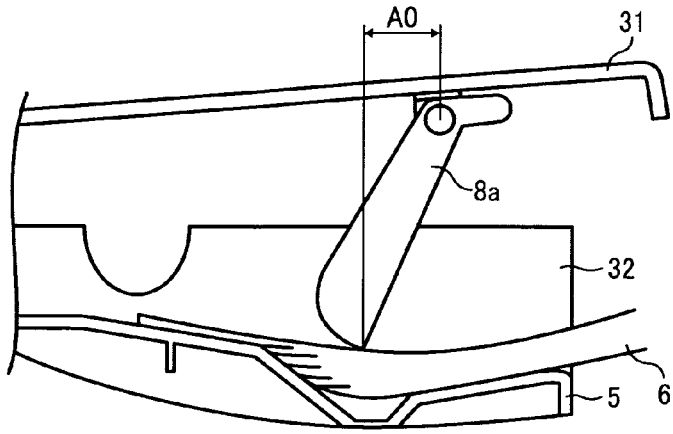
FIG. 4 is a diagram of a comparative example of a configuration of a document detection feeler unit.

FIG. 4 is a cross-sectional view of a comparative example of a document detection feeler unit and a cover. The reference numeral of corresponding units and components in FIG. 4 are described same as those illustrated in FIG. 3.

As illustrated in FIGS. 2 through 4, the document detection feeler unit 8 is generally supported by the cover 31. According to this configuration, when the user closes the cover 31, the document stack 6 that remains on the document setting table 5 abuts against the feeler 8*a*, which results in damaging the document stack 6 or the feeler 8*a* itself. This problem may tend to occur in a case where a distance A0 between a hinged support of the feeler 8*a* and a contact portion where the leading edge of the feeler 8*a* contacts the upper surface of the document stack 6 is relatively shorter. In this case, if the feeler 8*a* inclines to form a slope to smoothly retreat without abutting against the upper surface of the document stack 6, damages to the document stack 6 and/or the feeler 8*a* itself can be avoided. However, as illustrated in FIG. 4, a guide portion of the document setting table 5 is inclined downward and upward or recessed so as to separate the document sheets of the document stack 6 reliably before the document sheets are fed. This recessed portion hinders the retreating movement of the feeler 8*a*. Further, the position of the hinged support of the feeler 8*a* requires to some extent to arrange the position of the feeler 8*a* for proper detection to detect the document stack 6 on the document setting tray 5 correctly. Furthermore, due to limitations of space, it may be difficult to increase the distance between the contact portion and the hinged support of the feeler 8*a* to retreat easily. Specifically, an overlapping amount B, which will be described later with FIG. 10, cannot be obtained largely to reduce the size of the device, and therefore it is difficult to increase the length of the distance A0.

Further, with the document stack 6 set on the document setting tray 5 in FIG. 1, the user may open the cover 31 for performing a maintenance service, for example. In this case, a problem similar to the above-described problem may occur.

To address the above-described problems, the configuration of the ADF 1 according to the present invention prevents damage to the document stack 6 and/or to the feeler 8*a* itself caused by the document detection feeler unit 8.

In the ADF 1 according to an embodiment of the present invention, the setting of the document stack 6 on the document setting tray 5 can be detected according to rotation of the feeler 8*a* of the document detection feeler unit 8 and switching of the ON/OFF signal of the photosensor 8*e*.

Figure 5:
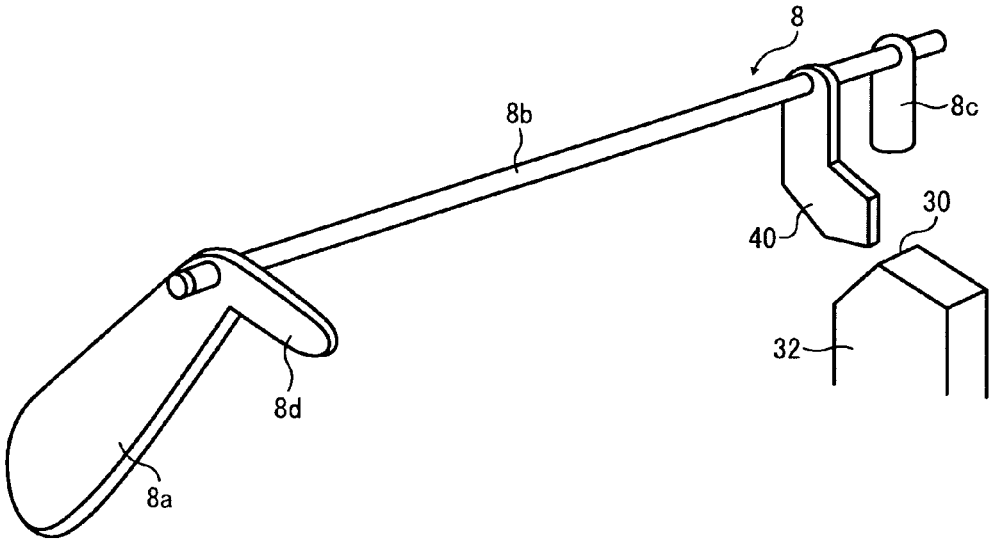
FIG. 5 is a perspective view of a document detection feeler unit of the automatic document feeder according to an embodiment of the present invention.

Referring to FIG. 5, a detailed description is given of the document detection feeler unit 8 according to this embodiment.

FIG. 5 is a perspective view of the document detection feeler unit 8. As illustrated in FIG. 5, the feeler 8*a* is fixedly mounted on the rotary shaft 8*b* that is rotatably disposed on the cover 31. When the document stack 6 set on the document setting tray 5 pushes the feeler 8*a*, the feeler 8*a* rotates together with the rotary shaft 8*b*. The feeler 8*a* is disposed within a restricted area or range corresponding to the width of a minimum-size document, that is, the smallest size of document that the apparatus can accommodate. The detection tab 8*c* is fixedly mounted on the rotary shaft 8*b* to rotate according to the rotation of the feeler 8*a*. This rotation of the feeler 8*a* blocks or allows a light beam to pass, which switches the through-beam sensor 8*e* ON and OFF. Whether or not the document stack 6 is set on the document setting tray 5 can be determined according to the output of the through-beam sensor 8*e*. It should be noted that the detection tab 8*c* is disposed outside a range corresponding to the maximum width of the document stack 6.

Further, a lever 40 is fixedly attached to the rotary shaft 8*b*. Similar to the detection tab 8*c*, the lever 40 is disposed outside the maximum width of the document stack 6. As the cover 31 is being closed, the lever 40 moves downward along a sloped contact portion 30 formed on a housing 32 of the ADF 1, which will be described later.

Due to the weight of the feeler 8*a*, the rotary shaft 8*b* of the document detection feeler unit 8 is constantly biased in a clockwise direction in FIG. 5. When the cover 31 is open and/or no document stack 6 is set on the document setting tray 5, the tongue portion 8*d* that is formed integrally with the feeler 8*a* contacts an inner face of the cover 31 so that the feeler 8*a* cannot move or rotate further and thus maintains the position of the feeler 8*a*.

Next, referring to FIGS. 6 through 10, descriptions are given of a rotary unit that rotates the feeler 8*a* as the cover 31 according to the present invention closes. For simplicity, a paper feed rib (or a paper feed surface) that is formed on an inner surface of the cover 31 or on a different member is omitted.

Figure 6:
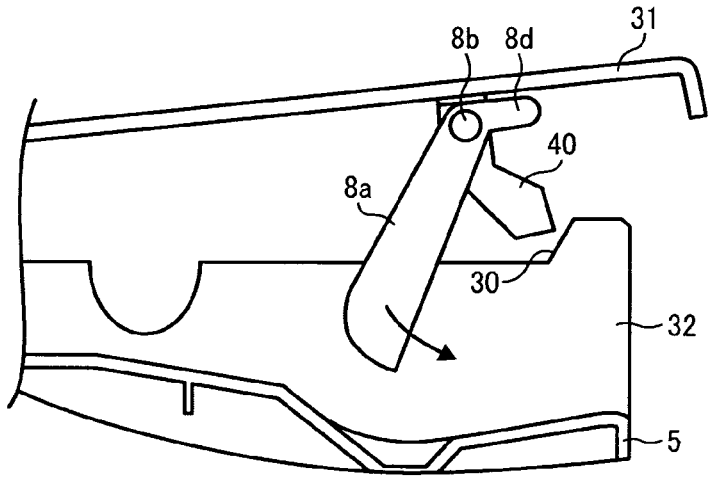
FIG. 6 is a diagram illustrating a state of the automatic document feeder according to the present invention when an upper cover provided to the automatic document feeder is slightly open.

FIG. 6 is a diagram illustrating a state in which the cover 31 is being closed. As illustrated in FIG. 6, the position and state of the feeler 8*a* when closing the cover 31 is determined by the tongue portion 8*d* that serves as a feeler position holding portion of the feeler 8*a* contacting the inner surface of the cover 31 with the rotational force exerted by the weight of the tongue portion 8*d*. By rotating the tongue portion 8*d* as described above, when the cover 31 is closed, the lever 40 that is fixedly attached to the rotary shaft 8*b* can contact the contact portion 30 formed on the housing 32 at the same position consistently, as illustrated in FIG. 5. When the lever 40 contacts the contact portion 30, the document detection feeler unit 8 rotates against gravity about the rotary shaft 8*b* in a counterclockwise direction as indicated by an arrow in FIG. 6. This rotation causes the feeler 8*a* to incline. Specifically, if the document stack 6 is set on the document setting tray 5, an angle formed between the upper surface of the document stack 6 and the underside ridge line of the feeler 8*a* can be reduced.

Accordingly, even if the cover 31 is opened and closed while the document stack 6 is set or remains on the document setting tray 5, the feeler 8*a* can incline immediately before contacting the upper surface of the document stack 6. Therefore, the risk that the feeler 8*a* damages the document stack 6 and/or the feeler 8*a* itself can be reduced significantly.

Further, when the cover 31 is closed and the feeler 8*a* is ready to move, the lever 40 slides down along the surface of the contact portion 30 and goes under the contact portion 30 and retreats therefrom. Therefore, the movement of the feeler 8*a* of the document detection feeler unit 8 is not hindered, thereby preventing problems such as misdetection of the existence of the document stack 6 on the document setting tray 5.

Figure 7:
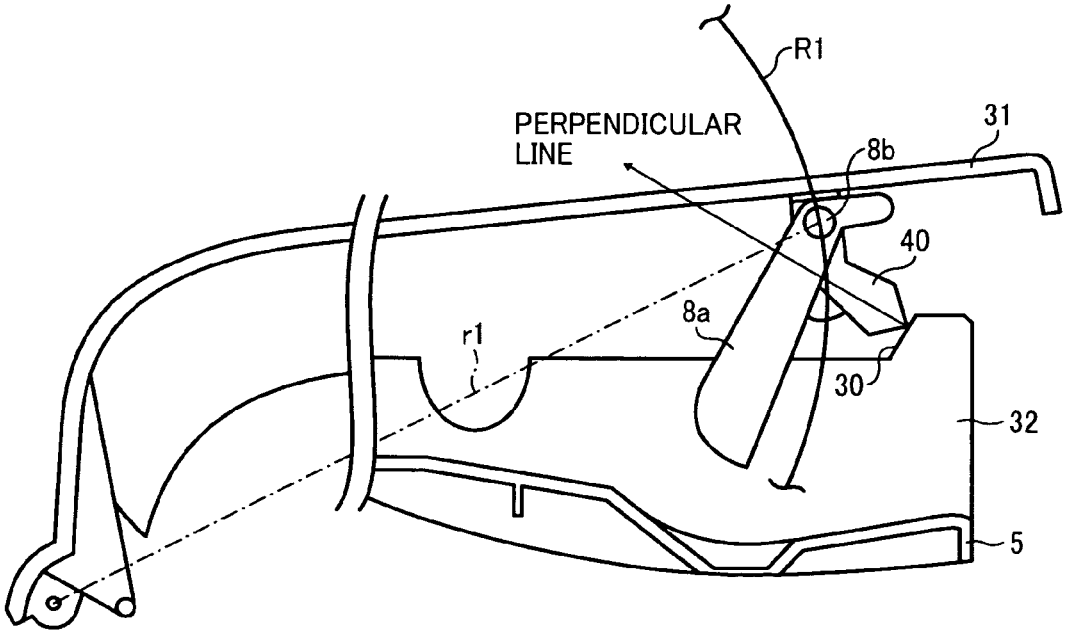
FIG. 7 is a diagram illustrating a state of the automatic document feeder of FIG. 6 when the upper cover is closed.

As illustrated in FIG. 7, it is preferable that the contact portion 30 is formed outside an arc R1 centered on a hinged support of the cover 31 and having a radius r1 that extends to the hinged support of the document detection feeler unit 8. By forming the contact portion 30 outside the arc R1, the hinged support of the feeler 8*a* comes close to the contact portion 30 as a user closes the cover 31, and therefore the feeler 8*a* can obtain a significantly larger inclination to retreat. Further, the contact portion 30 is formed by a slope that extends upward from the hinged support of the cover 31. With this configuration, the feeler 8*a* can be given a wide range of movement.

Furthermore, as illustrated in FIG. 7, a perpendicular line, that is a line perpendicular to the slope of the contact portion 30 at a contact point with the document detection feeler unit 8 has an angle that is formed in a direction such that the feeler 8*a* of the document detection feeler unit 8 rotates against the weight thereof or the biasing member with respect to the hinged support of the document detection feeler unit 8, thereby retreating the feeler 8*a* smoothly.

Figure 8:
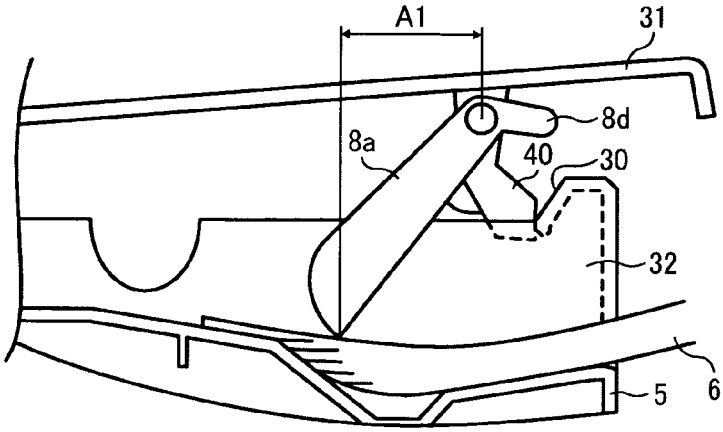
FIG. 8 is a diagram illustrating a state of the automatic document feeder when the upper cover is closed while documents are set on the document setting tray up to the maximum allowable height.

FIG. 8 illustrates a diagram illustrating a state of the ADF 1 when the cover 31 is closed with the document stack 6 set on the document setting tray 5 up to the maximum allowable height.

In this embodiment, when the feeler 8*a* contacts the upper surface of the document stack 6, a spindle-shaped leading end of the lever 40 contacts the contact portion 30 at approximately the same time. Alternatively, the lever 40 can contact the contact portion 30 after the feeler 8*a* has contacted the upper surface of the document stack 6. In this case, since the angle of the cover 31 is added to the angle between the upper surface of the document stack 6 and the underside ridge line of the feeler 8*a*, the feeler 8*a* does not damage itself and/or the document stack 6.

The feeler 8*a* starts to incline downward when a distance between the leading end of the feeler 8*a* and the center of the rotary shaft 8*b* becomes approximately equal to a distance A1 as illustrated in FIG. 8.

Figure 9:
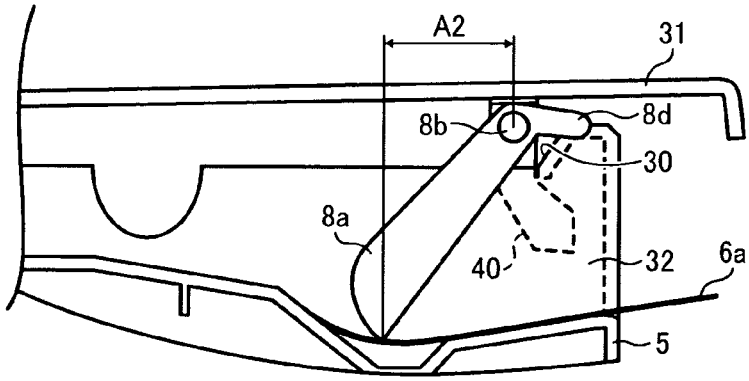
FIG. 9 is a diagram illustrating a state of the automatic document feeder when the upper cover is closed while a single document is set on the document setting tray.

FIG. 9 is a diagram illustrating a state of the ADF 1 when the cover 31 is closed while a single document 6*a* is set on the document setting tray 5.

Figure 10:
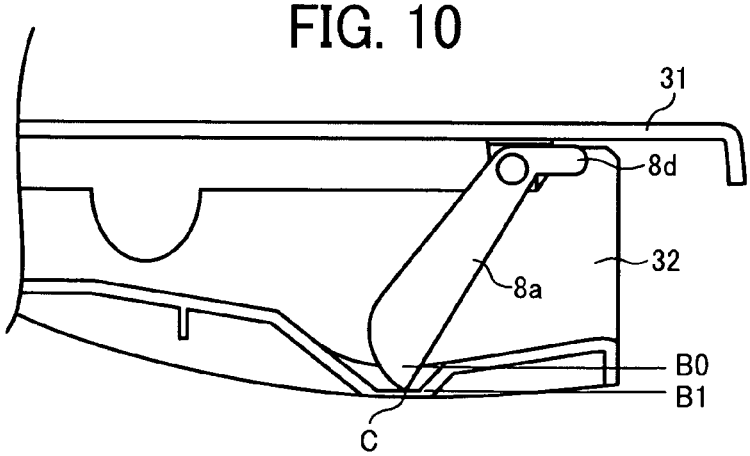
FIG. 10 is a diagram illustrating a state of the automatic document feeder when no document is set on the document setting tray.

As illustrated in FIG. 9, in a case where a single document 6*a* is left on the document setting tray 5, the lever 40 remains in contact with the contact portion 30 until the feeler 8*a* contacts the document 6*a*. When the document stack 6 set on the document setting tray 5 includes a relatively small number of sheets and a relatively low height in total, the contact angle between the feeler 8*a* and the upper surface of the document stack 6 approaches a right angle. Therefore, it is necessary that the lever 40 contacts the contact portion 30 to cause the feeler 8*a* to incline until this condition is attained. When the document setting tray 5 holds a single document 6*a* as illustrated in FIG. 9, a contact distance is set to a distance A2, the length of which is greater than that of the distance A0 so as to avoid damage to the document 6*a* and the feeler 8*a* itself. Therefore, the lever 40 contacts the contact portion 30 until the leading end of the feeler 8*a* reaches the distance A2 and the feeler 8*a* inclines or slants downward. If the leading end of the feeler 8*a* exceeds the distance A2, the lever 40 needs to separate from the contact portion 30. The purpose of this separation of the lever 40 from the contact portion 30 is to locate the feeler 8*a* at its home position in a completely free condition when the cover 31 is completely closed in a state in which no document is set on the document setting tray 5, as illustrated in FIG. 10. By so doing, the feeler 8*a* can reliably detect that the document stack 6 is set on the document setting tray 5 when the leading end of the feeler 8*a* contacts the upper surface of the document stack 6 at a height B0 that indicates a single document is set as illustrated in FIG. 9, and that no document stack 6 is set on the document setting tray 5 when the leading end of the feeler 8*a* does not contact any document at a height B1 to indicate no document is set, as illustrated in FIG. 10.

Figure 11:
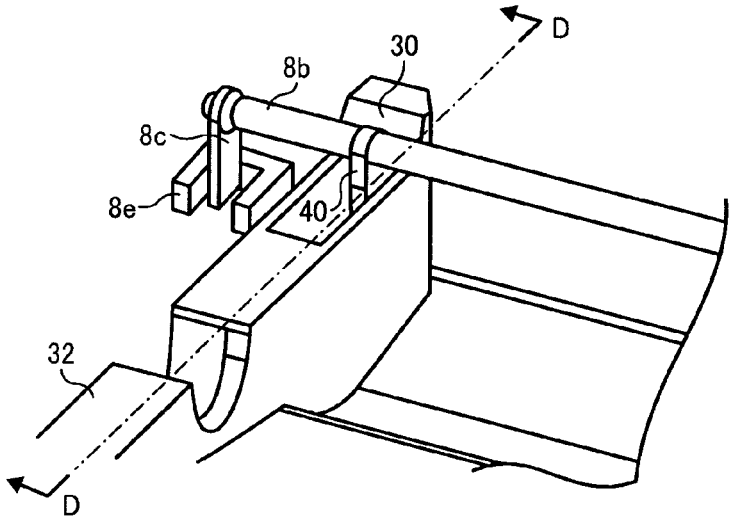
FIG. 11 is a perspective view illustrating a relative position of a lever and a contact portion of a housing of the automatic document feeder.
Figure 12:
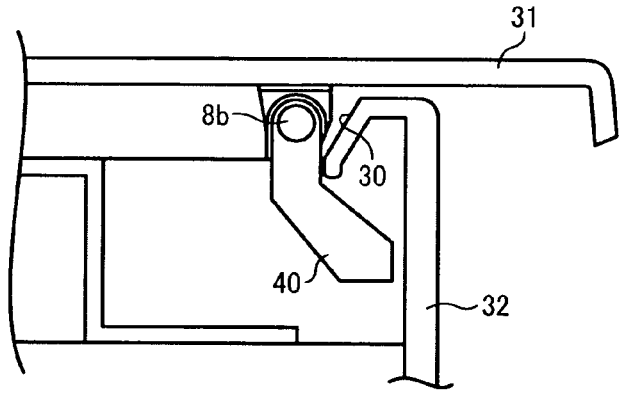
FIG. 12 is a cross-sectional view of the automatic document feeder, taken along a line D-D of FIG. 11.
Figure 13:
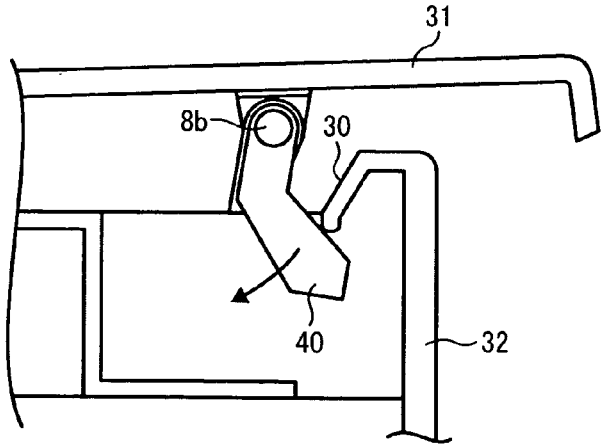
FIG. 13 is a cross-sectional view of the automatic document feeder, taken along a line D-D of FIG. 11, in a different state from the state of the automatic document feeder of FIG. 12.

FIG. 11 is a perspective view of the contact portion 30 of the housing 32 and the lever 40. FIGS. 12 and 13 are cross-sectional views, taken along a line D-D of FIG. 11, illustrating different states of the lever 40 and the contact portion 30 of the housing 32.

FIGS. 11 to 13 show the lever 40 attached to the rotary shaft 8*b* of the document detection feeler unit 8 in a condition in which the lever 40 no longer contacts the contact portion 30 of the housing 32 and rests beyond a distal end of the slope of the contact portion 30. As illustrated in FIG. 10, the feeler 8*a* contacts a point C on a guide portion that corresponds to the recessed portion of the document setting tray 5 so as to maintain the position thereof. To prevent chattering, it is advantageous to determine the position not based on the tongue portion 8*d* that has a shorter arm but based on the feeler 8*a* that has a longer arm.

Further, as illustrated in FIGS. 11 through 13, as the cover 31 moves to open, an angled lower portion of the lever 40 contacts the housing 32, which rotates the feeler 8*a* in the clockwise direction as indicted by arrow in FIG. 13. During this action taken for opening the cover 31, the feeler 8*a* may not receive any mechanical stress.

Figure 14:
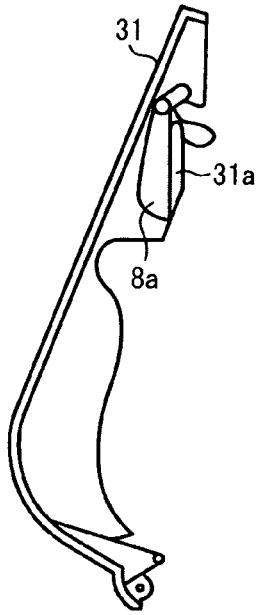
FIG. 14 is a diagram illustrating the upper cover when it is open.

Next, referring to FIG. 14, a description is given of a state of the feeler 8*a* and the cover 31 when the cover 31 is opened for paper jam handling or maintenance service.

As illustrated in FIG. 14, the movement of the cover 31 is regulated at a regulating portion so that the cover 31 does not open further beyond the regulating portion and is held by a holding member to maintain the cover 31 in the open state. With this configuration, a user or a service representative can perform paper jam handing and maintenance service easily without holding the cover 31.

A paper feed rib 31*a* or a paper feed surface is formed integrally or individually on the cover 31. When the cover 31 is open, if the feeler 8*a* does not fit within the size of the paper feed rib 31*a*, the user may contact and break the feeler 8*a* while handling paper jam or providing a maintenance service.

It is desirable to set a weight balance of the feeler 8*a* to fit within the size of the paper feed rib 31*a* when the cover 31 is open. By so doing, the user can reduce the possibility to contact the feeler 8*a* while handling paper jam.

Further, by providing the lever 40 not to incline in a forward direction but to incline a backward direction, it is more avoidable for the user to contact the feeler 8*a* while handling the jam.

Figure 15:
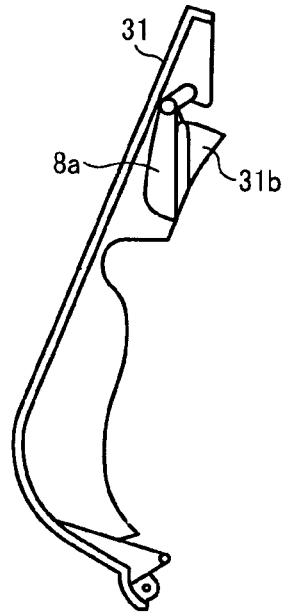
FIG. 15 is another diagram illustrating the upper cover when it is open.
Figure 16:
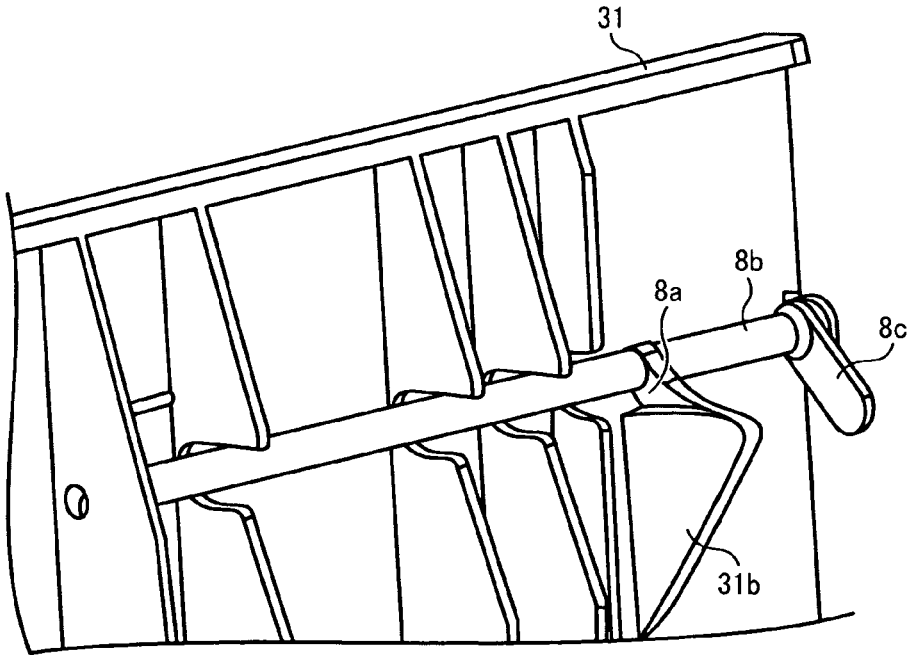
FIG. 16 is a perspective view illustrating the upper cover of FIG. 15 when it is open.

Further, as illustrated in FIGS. 15 and 16, by forming a blinder portion 31*b* on the cover 31 to hide the feeler 8*a* thereto when the cover 31 is opened, it can be more prevented for a user to contact the feeler 8*a* while the user is handling a paper jam.

The above-described embodiment of the present invention, however, is not limited thereto but can be modified in types and components.

For example, to bias the power of the document detection feeler unit 8 is not limited to use the weight thereof for biasing but can use a biasing member such as a spring. Even in case of using the weight of the feeler 8*a* of the document detection feeler unit 8, it can be rotated by using an appropriate weight member.

The above-described embodiments are illustrative and do not limit the present invention. Thus, numerous additional modifications and variations are possible in light of the above teachings. For example, elements or features of different illustrative and exemplary embodiments herein may be combined with or substituted for each other within the scope of this disclosure and the appended claims. Further, features of components of the embodiments, such as number, position, and shape, are not limited to those of the disclosed embodiments and thus may be set as preferred. It is therefore to be understood that, within the scope of the appended claims, the disclosure of the present invention may be practiced otherwise than as specifically described herein.

The invention claimed is:

1. An automatic sheet feeder, comprising:

a sheet setting unit including a housing, to set a sheet to be fed by a sheet feeding member;

an openably closable cover rotatably disposed over an upper portion of the sheet setting unit;

a sheet detector rotatably supported on the cover to detect whether or not a sheet is set on the sheet setting unit, the sheet detector comprising a detection member, a rotary shaft about which the detection member rotates and to which the detection member is fixedly attached, and a sensor to detect the sheet set on the sheet setting unit according to a movement of the detection member; and a rotating member to cause the detection member of the sheet detector to rotate in a direction such that an angle between a line that extends in a longitudinal direction of the detection member and a surface of the sheet set on the sheet setting unit decreases as the cover rotates from an open position to a closed position, wherein the rotating member includes a lever that is fixedly attached to the rotary shaft and contacts the housing of the sheet setting unit, as the cover closes, to rotate in a direction such that an angle between the detection member and the surface of the sheet decreases.

2. The automatic sheet feeder according to claim 1, further comprising:

a support for the cover and a support for the detection member; and a contact portion of the housing where the housing of the sheet setting unit contacts the lever, the contact portion located outside an arc centered on the support for the cover and drawn through the support for the detection member.

3. The automatic sheet feeder according to claim 2, wherein the contact portion of the housing is a sloped surface for the lever to move therealong from a contact portion toward a support for the cover as the cover closes.

4. The automatic sheet feeder according to claim 1, wherein the lever passes under the contact portion and withdraws therefrom when the detection member reaches a position lower than a lowest position of the sheet placed on the sheet setting unit prior to the detection member reaching a home position thereof.

5. The automatic sheet feeder according to claim 1, wherein the sheet detector detects that the sheet is set on the sheet setting unit according to a movement of the detection member from a home position thereof to a sheet detection position, the detection member being supported to the home position thereof and the rotating member rotating the detection member to the sheet detection position against the supporting action for the detection member.

* * * * *